United States Patent [19]

Cecil et al.

[11] Patent Number: 4,771,684

[45] Date of Patent: Sep. 20, 1988

[54] EXPRESSING LIQUID FROM SOURCE MATERIAL

[76] Inventors: John E. Cecil; Rachel K. Cecil, both of 9 School Place, Oxford, England, OX1 4RG

[21] Appl. No.: 945,758

[22] Filed: Dec. 22, 1986

[30] Foreign Application Priority Data

Jan. 8, 1986 [GB] United Kingdom ..... 8600143

[51] Int. Cl.[4] ..... B30B 9/02

[52] U.S. Cl. ..... 100/131; 100/122; 100/211

[58] Field of Search ..... 100/122, 123, 124, 131, 100/132, 211, 116; 210/350, 351; 99/495; 604/316, 74, 75

[56] References Cited

U.S. PATENT DOCUMENTS

| | | | |
|---|---|---|---|
| 1,021,578 | 3/1912 | DeLaney | 604/74 X |
| 2,419,795 | 4/1987 | Saunders | 604/74 |
| 3,269,157 | 8/1966 | Ashley | 100/211 X |
| 4,438,690 | 3/1984 | von Allworden | 100/211 X |

*Primary Examiner*—Werner H. Schroeder
*Assistant Examiner*—Andrew M. Falik
*Attorney, Agent, or Firm*—Martin LuKacher

[57] ABSTRACT

Apparatus and a method of expressing fluent liquid (e.g. juice) from source material comprise subjecting inner and outer surfaces of pressure application means (1) to a pressure differential constituted by applying suction (7,8) to both the source material and the inner surface of the pressure application means while the outer surface of the pressure application means is acted upon by free pressure of the earth's atmosphere, such that the inner surface of the pressure application means transmits to the source material at least a portion of the pressure differential, and fluent liquid is expressed from the source material.

10 Claims, 3 Drawing Sheets

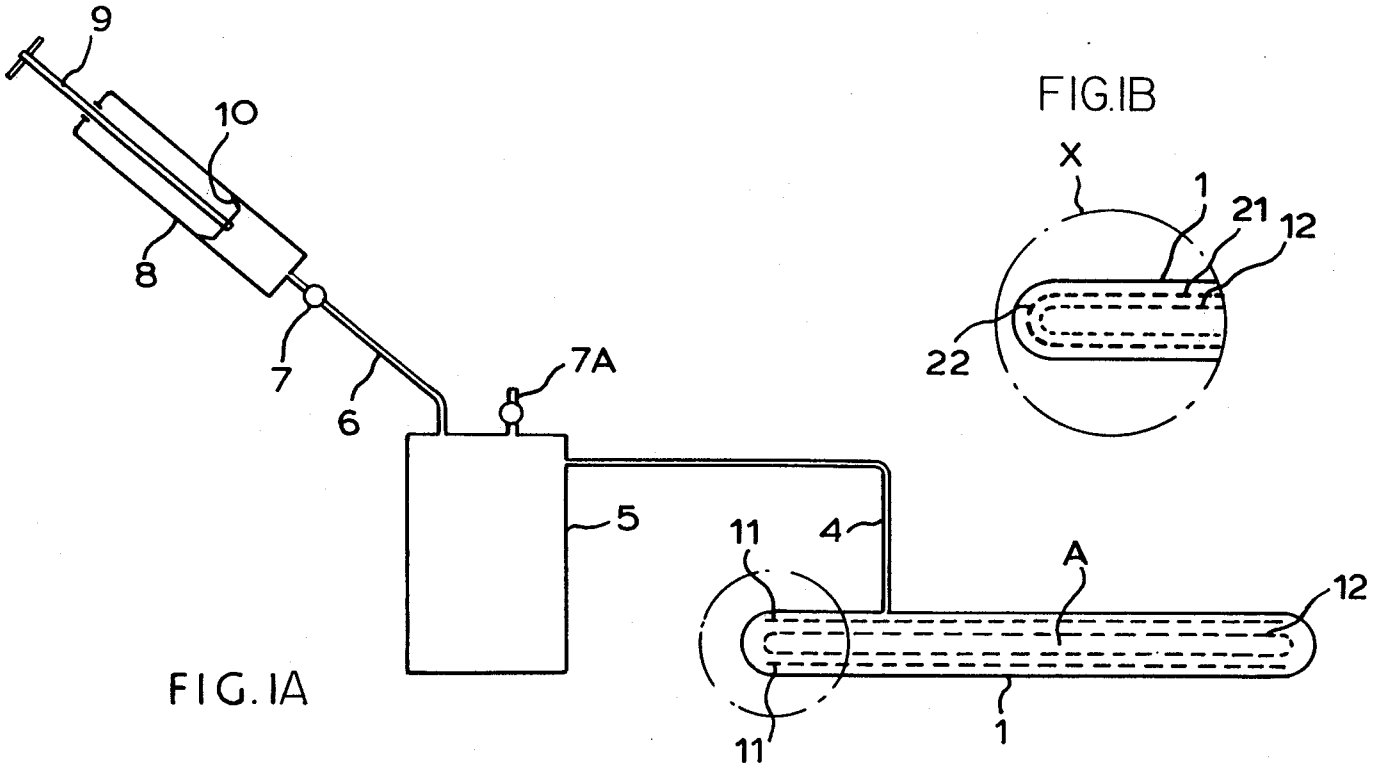
FIG.IA

EXPRESSING LIQUID FROM SOURCE MATERIAL

Fluent liquid can be expressed from suitable material comprising liquid and solid components. Such a material is called herein "source material". A source material can have any constitution appropriate to expressing liquid, e.g. be at least partly of animal, plant, or synthetic origin. The expressed liquid can have any constitution, e.g. be an aqueous emulsion, solution, or suspension (for instance contain sedimentable particulate material). Solid residue left after expressing liquid can have any constitution.

Fluent liquid can be expressed from source material by applying to the source material compression from pressure application means actuated by actuation means. One known pressure application means is a cloth for wringing suitable source material, the cloth being actuated by a person's hands. Another known pressure application means is a wall (e.g. a plunger's end surface) movable to compress source material, the plunger being actuated by hydraulic mechanism or by screw/nut mechanism. The need to compress the source material places constraints on the nature of the compressive force and/or apparatus, and on the yield of expressed liquid, etc. A result of those constraints is that manually operated apparatus for expressing liquid is not especially versatile for kitchen use, when varying quantities of expressed liquid are to be collected.

One known domestic press for expressing juice from fruit portions comprises a cup of a size roughly corresponding to a person's hand. A portion of fruit is placed in the cup, followed by a rigid presser plate contacting the portion of fruit. The plate and cup are mounted to respective first ends of two armlike bars pivotally connected at their opposite second ends so that those bars can be pressed together by a person's hand or hands, and thereby urge the rigid presser plate against the fruit portion in the cup. The compressive force exerted by the presser plate is relatively small. Another known domestic press is a rigid assembly comprising a perforated container (usually cylindrical) for source material, and a screw/nut mechanism for causing a rigid presser plate to compress the source material, and express liquid therefrom. The rigid assembly can be clumsy to clean or store.

It has now been found according to the present invention that free pressure of the earth's atmosphere can be at least partly used to aid or enable liquid to be expressed from source material, by utilizing suction acting on both the source material and on pressure application means responsive to free pressure of the earth's atmosphere. By "free pressure of the earth's atmosphere" is meant that the pressure application means is acted on by the earth's atmosphere in a free or natural stage, e.g. when the pressure application means is directly exposed to the earth's atmosphere. Thus, a distinction is drawn from an atmospheric engine wherein a portion of the earth's atmosphere is subjected to compression.

A first aspect of the present invention provides apparatus for expressing fluent liquid from source material, said apparatus comprising:

pressure application means having first and second surfaces for being subjected to a pressure differential constituted by applying suction to both the source material and the first surface of the pressure application means while the second surface of the pressure application means is acted upon by free pressure of the earth's atmosphere, such that the first surface of the pressure application means transmits to the source material at least a portion of the pressure differential, whereby liquid is expressed from the source material;

container means for containing the source material while the source material is subjected to said suction; and supply means for supplying suction to the source material and the first surface of the pressure application means.

A second aspect of the present invention provides a method of expressing fluent liquid from source material, said method comprising: subjecting first and second surfaces of pressure application means to a pressure differential constituted by applying suction to both the source material and the first surface of the pressure application means while the second surface of the pressure application means is acted upon by free pressure of the earth's atmosphere, such that the first surface of the pressure application means transmits to the source material at least a portion of the pressure differential, and fluent liquid is expressed from the source material, said method preferably comprising utilising apparatus according to the first aspect of the invention.

The present invention can be applied to any suitable application, e.g.:

expressing fluent liquid from cooked or raw fruit or vegetable materials;

expressing whey from curds and whey;

expressing aqueous fluent liquid from muscular tissue, e.g. fish or meat;

expressing fluent liquid dyes from dye precursors, e.g. of plant origin;

expressing fluent emulsions from nut residues, e.g. coconut endosperm; and expressing oil and fluent aqueous liquids from olives. The residual solids can be useful products, e.g. cheese curds or pressed muscular tissue. The present invention is especially suitable for kitchen use in expressing juice from e.g. berries or other soft fruit. The present invention can be embodied in any suitable manner, especially for kitchen or other domestic use. The present invention can be embodied for industrial use, especially small scale industrial use, and in low technology environments.

In the present invention, said pressure application means and/or container means preferably collapse (e.g. flatten) to conform to or correspond to at least part of the shape of source material before, during, and after application of said suction. Said pressure application means and/or said container means can be collapsable to reduce the percolation path of expressed fluent liquid. At least a portion of said collapse can be aided or enabled by applying at least one external force to said container means, e.g. by application of a person's hand or foot. Said external force can be applied in any suitable manner for any suitable period of time, e.g. to at least one locality on the exterior of said container means. Preferably, said first and second surfaces are comprised or constituted by said container means; e.g., wall material of said container means can comprise or constitute at least a portion of said pressure application means. The source material can be in direct contact with the inner surface of said container means, e.g. the inner surface of flexible container means, e.g. bag or sleeve. However, said container means can include at least one partition means for distancing at least a portion of said container means (e.g. wall material of said container means) from at least a portion of the source material. Said at least one partition means can comprise at least one inner container (e.g. bag or sleeve) relative to said container means, said inner container being porous for fluent expressed liquid to pass therethrough. Said inner container can have porous wall material for fluent expressed liquid, e.g. that wall material can comprise meshwork, or a cloth whose weave defines apertures, or a membrane pierced with apertures, or other openwork. Said container means and/or any said inner container can be disposable. At least a portion of said container means and/or any said inner container may be flexible and/or resilient. The flexibility or resiliency can be constituted in any suitable manner, e.g. by flexibility or resiliency of wall material, and/or by articulation of wall material (e.g. a bellows construction). A container assembly comprising said container means and at least one said inner container may be a performed composite structure, or be constituted in any other suitable manner.

Said supply means can comprise at least one component for passage of fluent liquids and/or gases, e.g. any component(s) chosen from: tubing; manually operable control means (e.g. a valve) controlling the tubing, e.g. so as to maintain a vacuum; at least one receptacle for receiving expressed fluent liquid drawn into said supply means by said suction. Said supply means can comprise or constitute distribution means for distributing suction to a plurality of said container means, at least two said container means respectively being able to receive suction at the same or different times. Preferably, said supply means comprises pump means for providing at least a portion of said suction. Preferably, said pump means is hand actuable, when the present invention is for kitchen or other domestic use. A preferred hand actuable pump is a pump comprising a piston within a barrel, said piston being adapted to suck air out of a container when the piston is moved outwardly from said barrel. Control means (e.g. a one-way valve) can be integral with or connected to (directly or indirectly) said pump means so as to aid or enable maintenance of suction provided by said pump means. In general, said control means can be at any suitable location, e.g. be mounted to said pump means, or in tubing, or to tubing (e.g. when said control means is comprised by collector means—see below).

Preferably, the apparatus of the present invention comprises collector means for collecting from said container means at least a portion of said expressed fluent liquid. Said collector means can be part of or separate from said supply means, e.g. at least one said receptacle can be part of said collector means. Said collector means can comprise at least one component for passage of fluent liquids and/or gases, e.g. any component(s) chosen from: tubing; manually operable control means (e.g. a valve) controlling that tubing; at least one receptacle for receiving expressed fluent liquid. Said collector means can comprise or constitute distribution means for distributing expressed fluent liquid to a plurality of receptacles, at least two of those receptacles respectively being able to receive expressed fluent liquid at the same or different times.

Components of the apparatus of the present invention can be disposed and/or embodied relative to each other in any suitable manners.

In the accompanying drawings, which are given by way of example of one embodiment of the present invention;

FIG. 1 shows apparatus for expressing e.g. juice from suitable grapes or other suitable material(s).

Figures 2A, 2B, 2C:
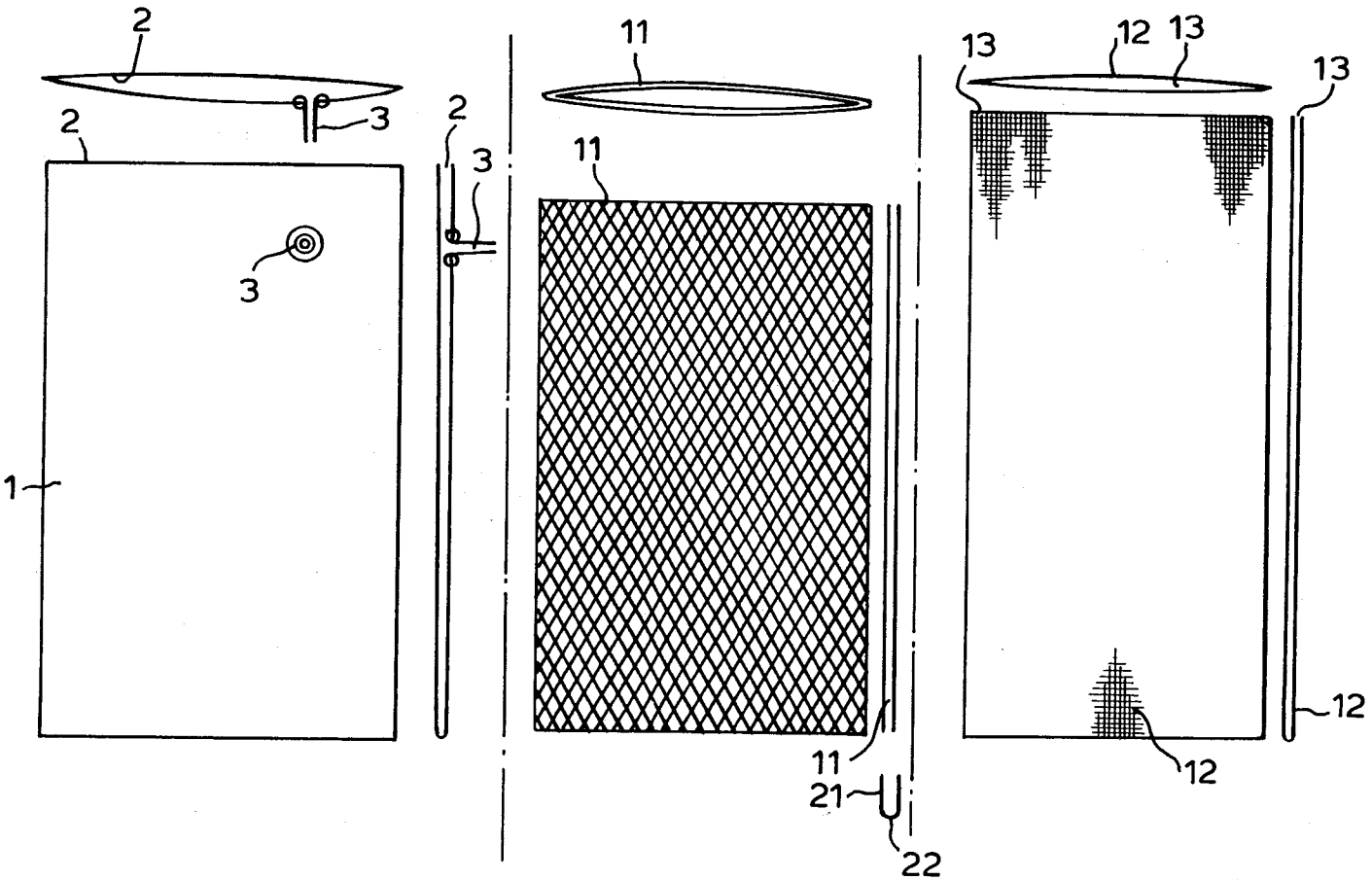
FIG. 2 is an exploded diagram showing an optional container assembly for use in the apparatus of FIG. 1.

In FIG. 1, a collapsable bag 1 contains grapes A from which juice is to be expressed. Bag 1 and its grapes can undergo flattening. Bag 1 is a flexible plastics bag (FIG. 2) having a sealable mouth 2 and a sealable outlet spigot 3. Mouth 2 can be sealed by a closure (not shown) that is optionally part of bag 1. Spigot 3 is controlled by a push on cap (not shown). Flexible plastics tubing 4 is pushed onto spigot 3. Tubing 4 leads to a jar 5 for receiving air and/or expressed juice drawn via tubing 4 from bag 1. The top of the interior of jar 5 communicates via flexible plastics tubing 6 through a one-way valve 7 with the inlet of a hand actuated pump 8, which is a conversion of a compression pump in which the piston or plunger 9 has had its washer 10 reversed so as to enable the pump to suck air from tubing 6 when the piston or plunger 9 is moved outwardly, i.e. withdrawn, and thereby provide reduced pressure inside bag 1. The reduced pressure is maintained by valve 7, and provides a pressure differential between the inside and outside of bag 1, the outside of bag 1 being acted upon by free pressure of the earth's atmosphere. As the reduced pressure is established in bag 1, the bag 1 collapses and/or shrinks around grapes A, which are thereby compressed to express juice that passes via tubing 4 into jar 5, from which the juice can eventually be removed. Jar 5 can be opened to remove its juice, e.g. by jar 5 having a top (not shown) from which the lower portion or body of jar 5 can be removed. The reduced pressure is released e.g. by opening the mouth of bag 1, or by opening a control valve (not shown) optionally in tubing 4 or 6 or optionally mounted in or to jar 5, such provision preferably enabling controlled entry of the earth's atmosphere into jar 5 and hence bag 1. Tubing 4 or 6 can be connected in any suitable manner(s) to jar 5, e.g. to the body and/or top of jar 5. That top is preferably a lid (e.g. screw or friction fit) to which those connections can be made.

The optional container assembly shown in FIG. 2 comprises bag 1, and a flexible mesh or other openwork sleeve 11 of plastics material surrounding a porous cloth bag 12 having an open mouth 13 that is closed (e.g. by folding the end over) when grapes A have been placed in bag 12. Sleeve 11 can be replaced by bag 21. When the grapes are compressed in the container assembly, expressed juice passes via bag 12, sleeve 11, spigot 3 into tubing 4. The pattern of flow (or the percolation path) of juice in bag 1 is predetermined by the sleeve 11 so that juice flows between bags 1 and 12 and then through spigot 3. Sleeve 11 preferably aids and/or enables juice to flow through a substantial portion of bag 12, such flow being preferred whether or not a partition means (e.g. sleeve 11) is present in bag 1.

Figure 3:
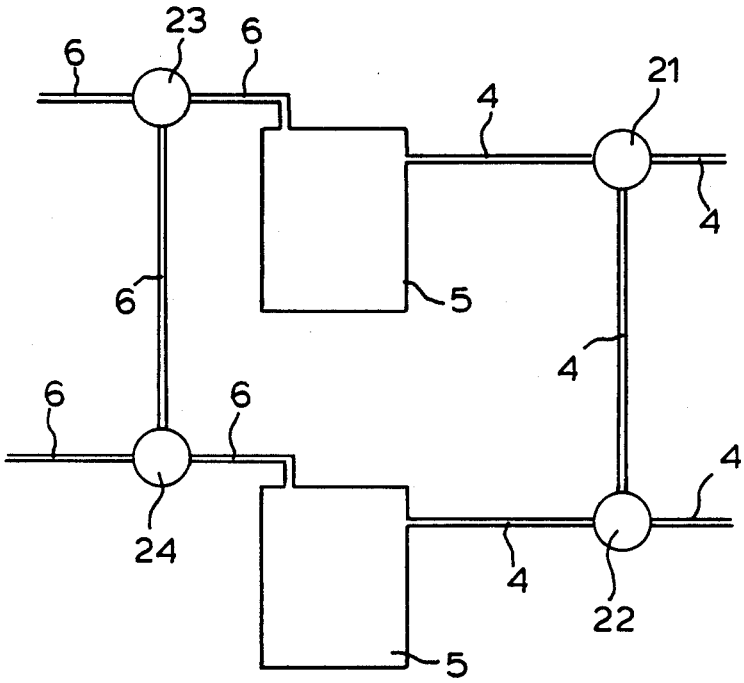
FIG. 3 shows an optional distribution system for use in the apparatus of FIG. 1.

FIG. 3 shows a distribution system for distributing vacuum and expressed juice to two jars 5 inter-connected by first flexible tubing 4 connectable to two bags 1. This tubing 4 contains two 3-way valves 21,22 for controlling flow directions in that tubing. The jars 5 are also inter-connected by second flexible tubing 6 connectable to two pumps 8. This tubing 6 contains two 3-way valves 23,24 for controlling flow directions in that tubing.

The apparatus in the accompanying drawings can be modified, e.g. according to the description given above before the first reference to the drawings. For example, FIG. 1 includes a fragmentary view X showing replacement of sleeve 11 by a mesh bag 21 having a closed end 22, and whose opposite end (not shown) can be closeable or open to permit bag 12 to be inserted into bag 21. The closeable end of bag 21 can be closed by folding that end over, but it is not essential to close that end. Bag 21 can be of flexible mesh or other openwork. One-way valve 7 can be at any suitable location, e.g. in tubing 6 (as shown) or when mounted in the top of jar 5 and connected to an end of tubing 6. Tubing can be constituted in any suitable manner, e.g. be flexible or rigid. A hand actuated pump 8 can be replaced by any other suitable pump, e.g. a foot or motor driven pump, or by any other means of removing air, e.g. an aspirator or ejector.

The present invention includes equivalents and modifications arising from all the disclosures within the present specification, including its drawings. It will be appreciated that the pressure application means can be termed movable pressure application means. It will be appreciated that externally applied crushing force may be exerted on a said collapsable container (e.g. bag 1) so as to aid expressing of juice from e.g. grapes or previously comminuted apples. FIG. 1 shows an optional one-way valve 7A mounted in the top of jar 5, that valve being an equivalent of valve 7, i.e. tubing 6 can be connected to valve 7A. The accompanying drawings are schematic.

We claim:

1. Apparatus for expressing fluent liquid from source material, said apparatus comprising:

pressure application means having first and second surfaces for being subjected to a pressure differential constituted by applying suction to both the source material and the first surface of the pressure application means while the second surface of the pressure application means is acted upon by free pressure of the earth's atmosphere, such that the first surface of the pressure application means transmits to the source material at least a portion of the pressure differential, whereby liquid is expressed from the source material;

container means for containing the source material while the source material is subjected to said suction; and supply means for supplying suction to the source material and the first surface of the pressure application means.

2. Apparatus as claimed in claim 1, wherein said first and second surfaces are comprised by said container means; and said container means is collapsable.

3. Apparatus as claimed in claim 2, wherein said container means is a bag.

4. Apparatus as claimed in claim 2, wherein said container means is a sleeve.

5. Apparatus as claimed in claim 1, wherein said container means comprises at least one partition means for distancing at least a portion of said container means from at least a portion of the source material.

6. Apparatus as claimed in claim 5, wherein said at least one partition means comprises at least one inner container relative to said container means, said inner container being porous for fluent expressed liquid to pass therethrough.

7. Apparatus as claimed in claim 1, wherein said supply means comprises pump means for providing at least a portion of said suction.

8. Apparatus as claimed in claim 7, wherein said pump means comprises a hand actuable pump comprising a piston within a barrel, said piston being adapted to suck air out of a container when the piston is moved outwardly from said barrel.

9. Apparatus as claimed in claim 1, comprising control means to aid and enable maintenance of said suction.

10. Apparatus as claimed in claim 1, comprising collector means for collecting from said container means at least a portion of said expressed liquid.

* * * * *